United States Patent [19]

Koss

[11] Patent Number: 4,714,248

[45] Date of Patent: Dec. 22, 1987

[54] BASKETBALL RETURN DEVICE

[76] Inventor: Richard E. Koss, 3530 E. 8th Ave., Denver, Colo. 80206

[21] Appl. No.: 882,170

[22] Filed: Jul. 7, 1986

Related U.S. Application Data

[63] Continuation-in-part of Ser. No. 761,320, Aug. 1, 1985.

[51] Int. Cl.[4] ..... A63B 69/40

[52] U.S. Cl. ..... 273/1.5 A; 124/78

[58] Field of Search ..... 273/1.5 A; 124/78, 50, 124/1

[56] References Cited

U.S. PATENT DOCUMENTS

| | | | |
|---|---|---|---|
| 2,700,379 | 1/1955 | Brigati | 124/50 X |
| 3,018,769 | 1/1962 | Parsoneault | 124/50 X |
| 3,308,802 | 3/1967 | Applegate | 124/78 |
| 3,776,550 | 12/1973 | McNabb | 273/1.5 A |
| 3,917,263 | 11/1975 | Wiley | 273/1.5 A |
| 4,193,591 | 3/1980 | Paulson | 124/78 |
| 4,280,697 | 7/1981 | Yuasa | 124/78 X |
| 4,323,048 | 4/1982 | Saito et al. | 124/78 |
| 4,352,348 | 10/1982 | Griffith | 124/78 |
| 4,372,284 | 2/1983 | Shannon | 124/78 |
| 4,561,414 | 12/1985 | Nozato | 124/78 |
| 4,579,340 | 4/1986 | Jenkins et al. | 273/1.5 A |

FOREIGN PATENT DOCUMENTS

| | | | |
|---|---|---|---|
| 2095565 | 10/1982 | United Kingdom | 124/78 |

*Primary Examiner*—Paul E. Shapiro

*Attorney, Agent, or Firm*—Gary W. Hamilton

[57] ABSTRACT

A ball return device for aiding in the practice of basketball or other games which require that a ball be returned to a player in order to perform repetitive practice routines. The device comprises a receiving basket which may be placed under a basketball hoop and which directs a ball to a pair of rotating heads operable to propel the ball toward the player. A detection apparatus on the return device is operable to sense the distance between a player and the return device. When the distance between the player and the return device is within a zone of acceptable distances, an output signal is generated which causes the return mechanism to eject a ball toward the player.

6 Claims, 6 Drawing Figures

BASKETBALL RETURN DEVICE

This is a continuation-in-part of Ser. No. 761,320, filed 8/1/85, owned by the same inventor.

FIELD OF THE INVENTION

The present invention relates to a device for aiding in the practice of basketball and other games that require the ball to be returned to the player in order to perform repetitive practice routines. More specifically, the present invention comprises a means for returning the ball to the player after it has passed through a basket. Alternatively, a multiplicity of balls can be stored in the mechanism for delivery to a player at timed intervals. The invention ball return mechanism comprises a ball delivery system which is capable of delivering a ball to multiplicity of locations on a playing court. The system includes a sensor for detecting the location of a player on a ball court. The output of the sensor provides a signal which is used by control circuitry to cause the system to eject a ball toward the player once he has been detected.

BACKGROUND

It is well known that basketball players must spend a great deal of time practicing to become proficient in the game. Because of the large dimensions of the basketball court, however, much time is wasted chasing stray balls after they have passed through the basket. Such wasted time is particularly frustrating to an experienced ball player attempting to perfect his technique, since even a properly thrown ball will not return to him after it has passed through the net of the goal.

Prior art basketball return mechanisms have generally been in the form of passive devices which do no more than direct the ball to the general vicinity of the player. Such devices provide little improvement over having no return mechanism at all.

SUMMARY OF THE INVENTION

The present invention overcomes the shortcomings of the prior art by providing a basketball return mechanism which may be placed under a hoop or basket and which directs a ball having passed through the hoop or basket to a pair of rotating heads which propel the ball in the direction of the player. The invention system comprises a lower support frame, an upper support frame which is journaled for rotation in the lower support frame and which supports a ball-receiving basket. A motor mounted on the lower support frame is operable to cause the upper support frame to rotate in an oscillatory spanning motion to allow the mechanism to direct balls in different directions. A sensing device on the upper support frame can detect the presence of a player within a certain range of distances from the mechanism and produces an output signal upon detection of the player. A control circuit which is responsive to the output signal from the sensor controls the actuation of a ball delivery system to eject a ball to the player after the player's presence has been detected by the system.

DETAILED DESCRIPTION OF THE PREFERRED EMBODIMENT

Figure 1:
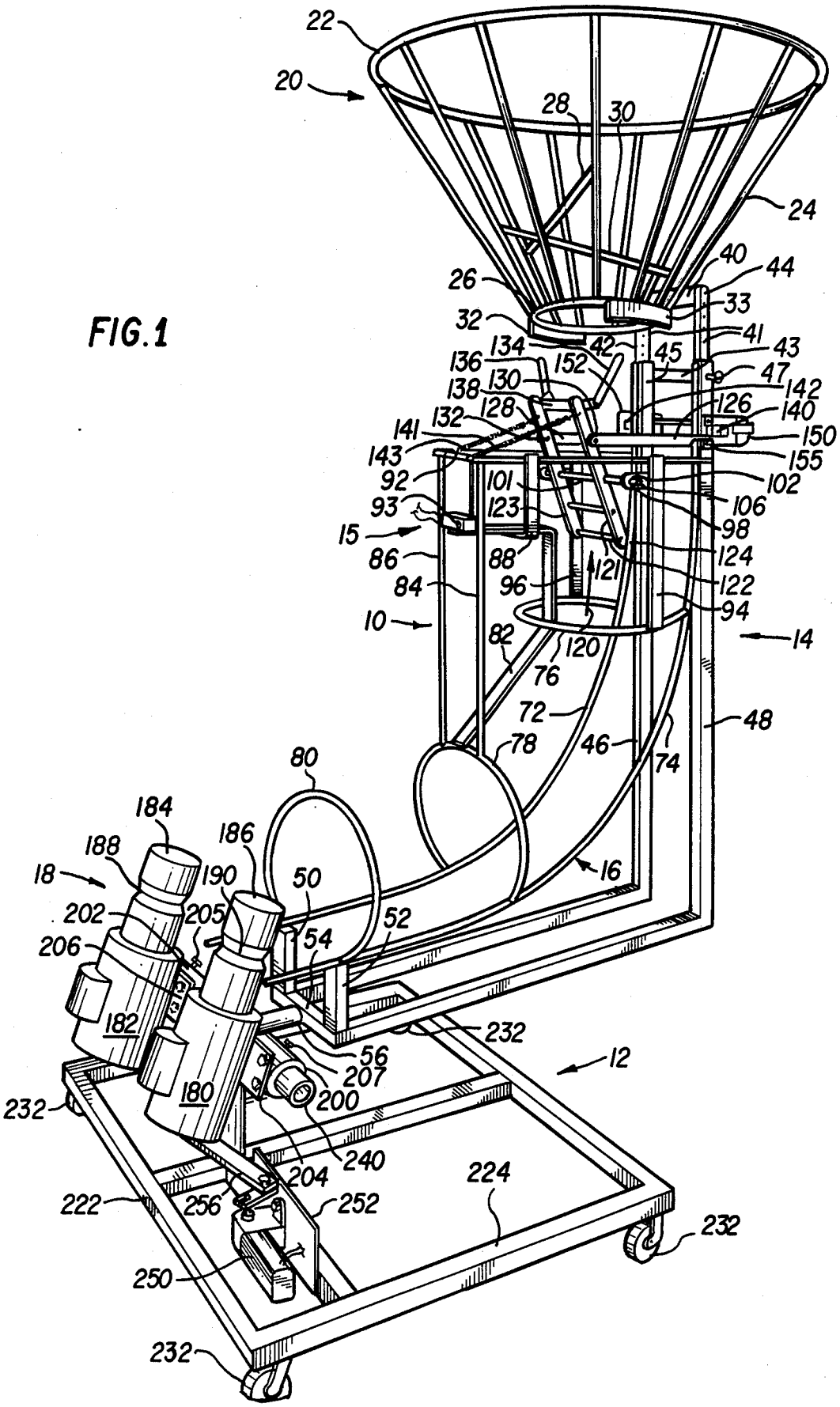
FIG. 1 is a perspective view of the basketball return mechanism of the present invention.

The basketball return mechanism 10 of the present invention is shown generally in FIG. 1. The device consists generally of a lower wheeled support frame 12, a movable upper support frame 14 pivotally mounted on the lower support frame, a receiving basket 20 for receiving a ball after having passed through a net, a delivery track 16, and a propelling mechanism 18 for propelling the ball to a player. A motor 250 on the lower support frame 12 is operable to cause the upper support frame to rotate in a spanning motion to direct balls in different directions. A sensing device 15 detects the presence of a player as the upper frame moves and provides an output signal used by the control circuitry, in manner described hereinbelow, to cause a ball release mechanism to eject a ball toward the player.

Figure 2:
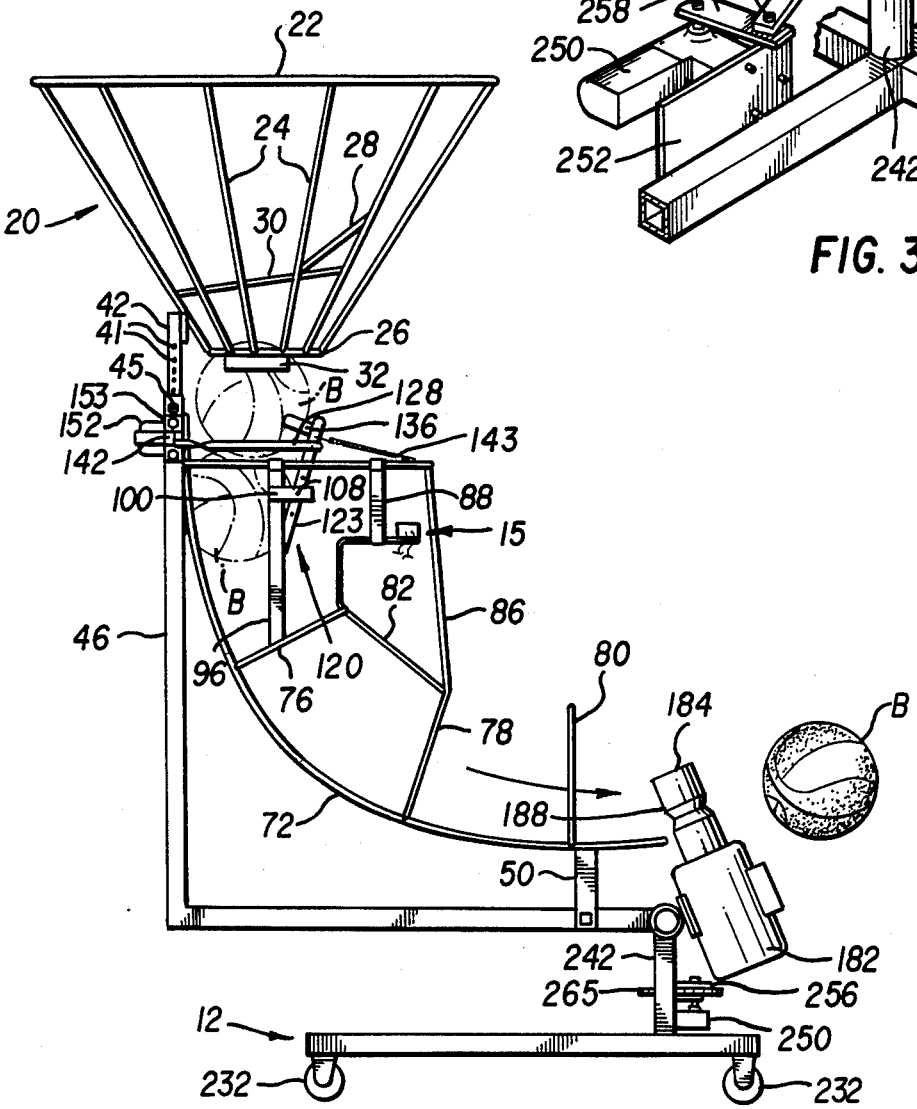
FIG. 2 is a side view of the basketball return mechanism of the present invention showing details relating to the transport of a ball through the receiving basket, along the delivery track, and to the propelling mechanism.

As may be seen in FIGS. 1 and 2, the receiving basket 20 is in the form of an inverted truncated cone. The basket 20 comprises an upper annular ring 22, a lower annular ring 26 and a multiplicity of radially-spaced support bars 24 extending from the upper ring 22 to the lower ring 26. A pair of rectangular guards 32, 33 are attached to the lower ring 26 on opposite sides thereof to prevent lateral movement of the ball as it passes through the basket. The receiving basket 20, as described above, may be used to direct a single ball to the propelling mechanism after the ball has passed through the net; alternatively, a multiplicity of balls may be stored in a basket and delivered to the player at timed intervals in a manner to be described in greater detail below. When the basket is being used in the latter mode, the balls stored in the basket are prevented from jamming in the bottom of the basket by antijam bars 28 and 30 which are attached at oblique angles between pairs of support bars 24 of the basket as shown in FIGS. 1 and 2.

The upper support frame 14 is generally L-shaped and comprises a pair of laterally spaced L-shaped members 46 and 48. The L-shaped members 46 and 48 are secured at their upright end by a cross member 43 and at the terminal ends of the lower horizontal portion by a cross member 54. A centrally disposed mounting shaft 56 is attached to cross member 54 and connects the upper support frame 14 to a T-shaped mounting bar 240 which is pivotally mounted in lower support frame 12.

The upright portions of the L-shaped members each have longitudinally extending cavities adapted to receive vertical legs 42 and 44 of an inverted U-shaped bracket 40 which is attached to two of the longitudinal support arms 24 at the rear of the receiving basket 20. The vertical legs 42 and 44 are received in inner concentric relation within the cavities of the upright portions of L-shaped members 46 and 48 and are movable therein so that the receiving basket 20 may be placed at a multiplicity of vertical positions beneath a basketball goal. The support bracket 40 is secured in the desired position by a pair of bolts 45 and 43 or other suitable fastening means extending through the upright portions of L-shaped members 46 and 48, respectively. Each of the bolts is received in one of a plurality of transverse bores 419 in each of the vertical legs 42 and 44, depending on the desired position of the basket 20.

Balls are transported from the receiving basket 20 to the propelling means 18 by a curved delivery track comprising a pair of curved tubular members 72 and 74. As may be seen in FIG. 2, the curved members 72 and 74 are attached at their upper ends to the upright portions of L-shaped members 46 and 48, respectively, and at their lower ends to upper terminal ends of upright bars 50 and 52, respectively said upright bars being attached at lower forward ends of L-shaped members 46 and 48. Lateral movement of the ball as it travels along the track is limited by arcuate rings 76, 78 and 80 each of which is attached to curved members 72 and 74 as shown in FIG. 2. Additional guidance is provided by a J-shaped rail 82 attached to upper portions of arcuate rings 76 and 78 as shown in FIGS. 1 and 2.

Structural rigidity of the track assembly is enhanced by an upper support frame comprising a U-shaped upper frame member 92 attached to L-shaped members 46 and 48 of the upper support frame 14. A first set of upright support bars 84 and 86 are each attached on one end to said U-shaped frame 92 at its forward end and depend downward therefrom with the opposite ends of the bars attached to the upper portion of arcuate ring 78 on either side of the point of attachment of J-shaped member 82. A second pair of upright support bars 94 and 96 are attached to the upper frame 92 at an intermediate point on each of the leg members of said frame and depend downward with opposite ends attached to intermediate point on opposite sides of arcuate ring member 76. Support brackets 98 and 100 are attached to upright bars 94 and 96 at upper intermediate point thereof and are used in connection with a support apparatus for the gate of the ball dispensing mechanism, as described below.

As may be seen in FIGS. 1 and 2, the ball dispensing mechanism of the present invention comprises a ladder-like gate member 120 comprising vertical side members 121 and 123 and having a plurality of transverse bars or rungs 122. The gate 120 is supported at a midpoint by a shaft 106 extending through vertical side members 121 and 123, said shaft being received in apertures 102 and 108 in support brackets 98 and 100, respectively. As may be seen in FIG. 1, the gate 120 may be pivoted about its central transverse axis by upper support arms 126 and 128 which are hingedly attached to vertical members 121 and 123, respectively, and slidably secured by brackets 153 and 155 to L-shaped members 48 and 46, respectively.

As may be seen in FIG. 1, the gate is normally biased toward a position at an angle with respect to the longitudinal axis of the upright portion of L-shaped members 46 and 48. The gate is normally maintained in this position by a biasing force provided by spring members 141 and 143. With the gate in the aforementioned position, the basketball may be captured on the upper portion of the track as shown in FIG. 2. A generally U-shaped bracket 138 with upwardly directed arms 134 and 136 is attached to the upper portion of the gate 120 to secure an additional ball for subsequent delivery to the track.

Electromagnetic actuators 150 and 152 are attached to the upright portion of L-shaped members 48 and 46, respectively, and are operable to engage magnets 140 and 142 attached to support bars 126 and 128 and thereby change the position of gate 120 to allow a ball to pass to the delivery track. The actuators may be controlled by a timing circuit or by a sonar or photodetector circuit which senses the postition of a player on the court, as described in greater detail hereinbelow. When the actuators are engaged, the magnets on the support arms are drawn toward the actuators and the gate 120 rotates counterclockwise from the position shown in FIG. 2. The ball is thus released and allowed to move along the track and engage the propelling means. When the magnetic actuators are deactivated, the spring members 141 and 143 move the support arms 126 and 128 and the gate 120 rotates clockwise to resume its normal position and thereby capture another ball for subsequent delivery to the track.

Figure 3:
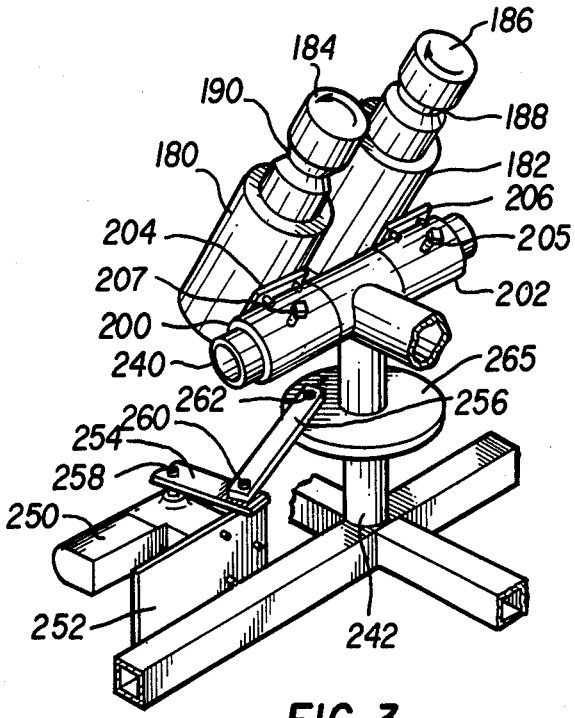
FIG. 3 is a perspective view of the propelling mechanism of the present invention showing details of the mounting of the motors in a swivel base.

Details relating to the ball propelling mechanism may be seen by referring to FIG. 3. The propelling mechanism comprises two electric motors 180 and 182 which are secured by mounting brackets 204 and 206, respectively, attached to annular collars 200 and 202. The annular collars 200 and 202 are slidably mounted on the horizontal shaft of a T-shaped mounting bar which is journaled for rotation on lower support frame 12. Fastening means 207 and 205 are attached to the collars and are operable to frictionally engage the mounting bar and thus secure the motors in a plurality of configurations depending on the desired attitude at which the ball is to be propelled.

As may be seen in FIGS. 1 through 3, rotatable heads 186 and 184 are attached to motors 180 and 182, respectively, to engage a ball passing between the heads. In the preferred embodiment, the heads are covered with rubber to aid in gripping the ball, although bare metal heads may be employed if less gripping effect is desired. As may be seen most clearly in FIG. 3, the head 184 on motor 180 rotates in a counterclockwise direction while the head 186 on motor 182 rotates in a clockwise direction. The spacing between the heads may be adjusted by securing the motors 180 and 182 at various locations along horizontal bar 240, as described hereinabove. The spacing between the heads may, therefore, be adjusted to allow the heads to engage balls having different diameters, such as volley balls.

The azimuthal position of the propelling mechanism is controlled by a motor 250 which causes the upper support frame to rotate with respect to the lower support frame. The motor 50 is secured to transverse member 230 of the lower support frame 12 by a rectangular mounting bracket 252. Movement of the motor is translated to the T-shaped mounting bar by a crank mechanism comprising connecting arms 254 and 256 which are coupled to form a crank arm which is attached to a circular platen secured to vertical shaft 242. When the motor 250 is activated, the upper frame will rotate with respect to the lower support frame 12 sweeping an arc of approximately 100 degrees.

Figure 4:
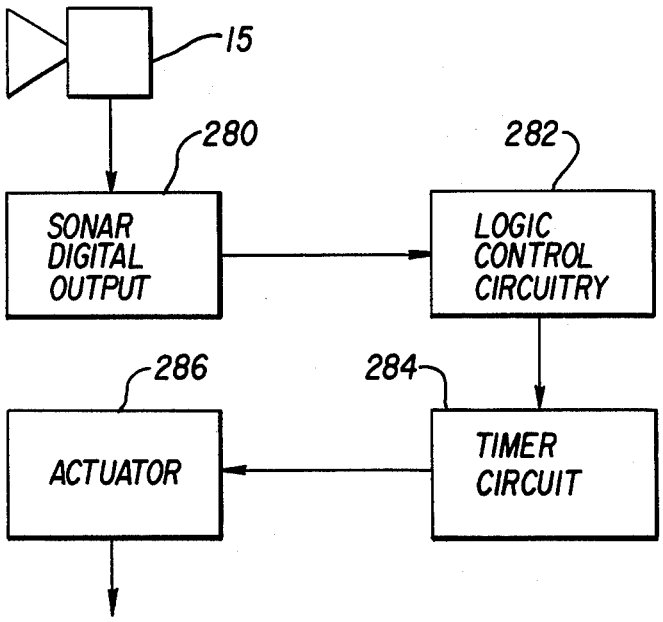
FIG. 4 is schematic block diagram of the control circuitry for detecting the presence of a player and for activating the ball delivery system.
Figure 5:
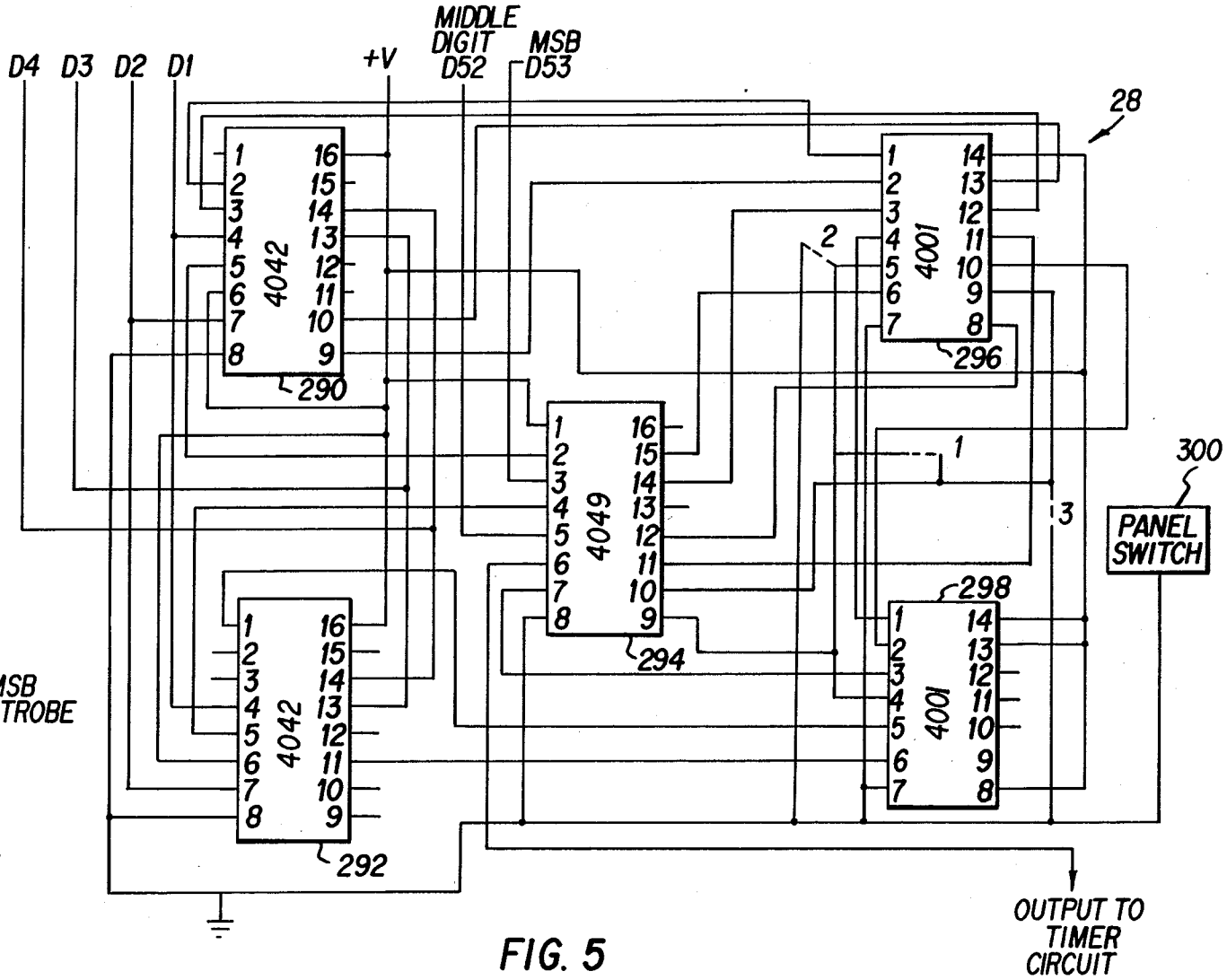
FIG. 5 is a schematic diagram of the logic circuit of the control circuitry used in the preferred embodiment of the present invention.
Figure 5A:
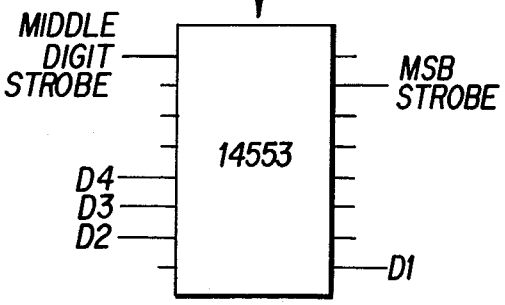
FIG. 5*a* is a schematic diagram of the digital output circuit of the sonar detection apparatus used in the preferred embodiment of the present invention.

Details relating to the operation of the detection apparatus 15 in combination with the control circuitry can be seen by referring to FIGS. 4, 5, and 5*a*. The detection apparatus used in the preferred embodiment is an ultrasonic ranging sensor, hereinafter sometimes referred to as a sonar detector. Although the sensor employed in the preferred embodiment is an ultrasonic device, a photodetector or other sensing apparatus could be employed.

An ultrasonic ranging sensor of the type used in the preferred embodiment is manufactured by Polaroid Corporation. This sensor is capable of detecting the presence and distance of objects within a range of 0.9 feet to 35 feet. The sensor provides a 3 digit multiplexed binary coded decimal output which can be used for direct interface with a microprocessor or logic control circuitry.

The use of the ultrasonic sensor, or sonar detector 15, in conjunction with the control circuitry can be seen by referring to the schematic block diagram of FIG. 4. As was discussed above, the detector used in the preferred embodiment comprises a digital output circuit 280 which can be used to provide an input signal for the logic control circuit 282. The logic control circuit 282 processes the data provided by the sonar digital output circuit 280 and provides an output signal which controls the operation of a timer circuit 284. Thus, when the output of the sonar digital output circuitry presents a signal indicating the presence of a player, the logic control circuitry will produce a signal activating the timer circuit 284 which, in turn, will provide a signal to the actuator 286 to cause the ball delivery system to eject a ball toward the player. The actuator, indicated schematically by the reference number 286, corresponds to the electromagnet actuators 150 and 152, shown in FIGS. 1 and 2 of the preferred embodiment. The timer circuit 284 can be adjusted to deliver balls at time intervals ranging from one second to 15 seconds.

Details relating to the logic control circuit 284 can be seen by referring to the schematic diagram shown in FIG. 4. The input to the logic control circuit 284 is provided by the 14553 counter circuit, shown in FIG. 5*a*, contained in the ultrasonic sensor of the preferred embodiment. As was discussed above, this circuit provides multiplexed data, illustrated by the outputs D1–D4, shown in FIG. 5*a*. These data output signals, together with the control strobe signals, provide the inputs for the logic control circuit of FIG. 5.

As can be seen by referring to FIG. 5, the logic control circuit 282 comprises two 4042 quad latch integrated circuits, a 4049 hexidecimal inverter integrated circuit and two 4001 quad nor integrated circuits. The output from pin 6 of the hexidecimal inverter provides the output from the circuit to control the operation of the timer circuit 284. A panel switch 300 can be used to select the distance from the ball return mechanism which the player must be in order to cause the system to deliver a ball. The dotted lines shown in FIG. 5 correspond to positions 1, 2, and 3 of the control switch 300. With the switch in position 1, the player must be between 10 and 14 feet from the machine in order for a ball to be delivered. Position 2 corresponds to a distance of 14–20 feet and position 3 corresponds to a position of 20 to 30 feet from the return mechanism.

The control circuitry used in the preferred embodiment can be effectively used by a player to increase the efficiency of his preactice session with the invention basketball return mechanism operating in either the stationary mode or the spanning mode. When using the device in the stationary mode, a multiplicity of balls can stored in the basket and the propelling mechanism is aimed to deliver balls to one particular location on the court. The player then sets the control circuitry to define a "zone," corresponding to the range from the machine which he must be in order to cause the machine to deliver a ball. Each time the player enters the predetermined zone, the sensor will provide a signal causing the control circuitry to actuate the ball delivery system, thus delivering a ball to the player. The rate of delivery of the balls can be determined by the timer.

With the basketball return device operating in the spanning mode, the upper portion of the device will rotate in an oscillatory motion. In this mode of operation, the player can move to different locations on the court within the predetermined zone of allowed distances from the detection device 15. As the mechanism spans and the player is detected by the detection device, the cotrol circuitry described above will cause the ball delivery system to eject a ball toward the player.

While the invention basketball return mechanism has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

I claim:

1. A basketball return mechanism, comprising:

a support frame;

ball receiving means attached to said support frame;

ball propelling means;

means for transporting a ball from said ball receiving means to said ball propelling means;

ball retaining means having a first position and a second position, said retaining means preventing passage of a ball from said ball receiving means to said ball transporting means with said retaining means in said first position and permitting passage with said retaining means in said second position;

means biasing said retaining means toward said first position;

actuator means for moving said retaining means to said second position;

means for detecting the position of a player relative to said basketball return mechanism, and for producing a first output signal upon detection of said player; and control means responsive to said first output signal from detecting means, said control means operable to produce a second output signal in response to said first output signal, said second output signal causing said actuator means to move said retaining means to said second position.

2. The basketball return mechanism according to claim 1, said detection means comprising an ultrasonic detector, said detector comprising digital circuitry for producing said first output signal.

3. The basketball return mechanism according to claim 2, said control means comprising logic circuitry for processing said first output signal and for producing said second output signal, said circuit including a switch for setting a zone of acceptable ranges of distances of said player from said detection means for which said second ouput signal will be generated.

4. A basketball return mechanism, comprising:

a lower support frame;

an upper support frame pivotally mounted on said lower support frame;

means for rotating said upper support frame with respect to said lower support frame;

ball receiving means attached to said upper support frame;

ball propelling means;

means for transporting a ball from said ball receiving means to said ball propelling means;

ball retaining means having a first position and a second position, said retaining means preventing passage of a ball from said ball receiving means to said ball transporting means with said retaining means in said first position and permitting passage with said retaining means in said second position;

means biasing said retaining means toward said first position;

actuator means for moving said retaining means to said second position;

means for detecting the position of a player relative to said basketball return mechanism, and for producing a first output signal upon detection of said player; and control means responsive to said first output signal from detecting means, said control means operable to produce a second output signal in response to said first output signal, said second output signal causing said actuator means to move said retaining means to said second position.

5. The basketball return mechanism according to claim 4, said detection means comprising an ultrasonic detector, said detector comprising digital circuitry for producing said first output signal.

6. The basketball return mechanism according to claim 5, said control means comprising logic circuitry for processing said first output signal and for producing said second output signal, said circuit including a switch for setting a zone of acceptable ranges of distances of said player from said detection means for which said second ouput signal will be generated.

* * * * *